US007889880B1

(12) United States Patent
Coffey

(10) Patent No.: US 7,889,880 B1
(45) Date of Patent: Feb. 15, 2011

(54) HEARING AID WIND-VORTEX NOISE PREVENTER BLANKET ACCESSORIES

(76) Inventor: Robert George Coffey, P.O. Box 535, Groveland, FL (US) 34736

( * ) Notice: Subject to any disclaimer, the term of this patent is extended or adjusted under 35 U.S.C. 154(b) by 1129 days.

(21) Appl. No.: 11/500,609

(22) Filed: Aug. 8, 2006

(51) Int. Cl.
*H04R 25/00* (2006.01)

(52) U.S. Cl. ..... 381/322; 381/328

(58) Field of Classification Search ..... 381/27–328, 381/330, 380–382; 181/129–131, 135; 128/864, 128/867, 205
See application file for complete search history.

(56) References Cited

U.S. PATENT DOCUMENTS 3,116,376 A 12/1963 Behmer
3,976,848 A 8/1976 Estes
4,073,366 A 2/1978 Estes
4,987,597 A * 1/1991 Haertl ..... 381/325
6,134,333 A * 10/2000 Flagler ..... 381/325
7,372,973 B2 * 5/2008 Meier ..... 381/330

* cited by examiner

*Primary Examiner*—Suhan Ni
(74) *Attorney, Agent, or Firm*—Elsie C. Turner

(57) ABSTRACT

This invention is directed to the elimination of the cause of hearing aid wind noise pollution which is referred to here as that form of audible vibrations generated by the energy of wind-produced vortices and eddy currents at the ear area and amplified by the hearing aid circuitry in the form of objectionable roar or burbles. Said invention constitutes a disposable porous blanket accessory provided for covering the obstructions and irregularities of the hearing aids in their operating mode and any pertinent outer ear area to prevent the formation of audible wind eddies, vortices, and burbles in the airstream. Said blanket is press-applied by use of an adhesive backing which is so affixed on the blanket surface as to preserve the porous nature of the blanket and its acoustic and electronic compatibility properties by either coating or impregnating only the individual fibers of the blanket surface to be so treated and thus retaining said properties.

13 Claims, 1 Drawing Sheet

HEARING AID WIND-VORTEX NOISE PREVENTER BLANKET ACCESSORIES

CROSS-REFERENCE TO RELATED APPLICATIONS

Not applicable

FEDERALLY SPONSORED RESEARCH

Not applicable

SEQUENCE LISTING OR PROGRAM

Not applicable

BACKGROUND OF THE INVENTION

1. Field of Invention

This invention is directed to the elimination of the cause of hearing aid wind noise pollution which is referred to here as that form of audible vibrations generated by the energy of wind produced vortices and eddy currents at the ear area and amplified by the hearing aid circuitry in the form of objectionable roar or burbles.

2. Prior Art

Ever since the invention of the hearing aid, wind noise pollution effect has been grudgingly accepted by hearing aid manufacturers and users. All wind noise suppression attempts have ended in frustrating failure. Many electronic circuits and systems both internal and external, acoustic deflectors, baffles, diaphragms, membranes, absorbers, wind screens, wind scoops, and multiples of other items have been created to seek relief from the phenomenon of hearing aid wind noise but with little to no operative effect.

Both the internal electronics methods and the external accessory methods attempt to cope with hearing aid noise after it has been created and admixed with the message. Both methods have eventuated as expensive failures to both the manufacturer and the wearer. In spite of customer interest, hearing aid vendors are not interested in handling the wind noise suppressors on the market and damn them with faint praise and disinterest. This attitude reflects the customer dissatisfaction with the wind noise suppressor, born of misunderstood aerodynamic theory and misconceived mechanical solutions.

Thus, all commercial wind noise suppressors that attempt to effect wind noise suppression by directing or blocking the wind flow not only fail to suppress said wind noise, but they also create further audible eddy currents or vortices. All are eliminated by the vortex eliminator patch disclosed herein.

Hereinafter, this hearing aid wind-vortex noise preventer blanket patch accessory may be variously referred to as the blanket patch, the blanket, or the patch.

OBJECTIVES AND ADVANTAGES

It is current aerodynamic knowledge that when a streamline flow of air is broken up about a body, eddy currents are formed, which run contrary to the main current and are most commonly noted when they move circularly in whirlpools or vortices. These disturbances, or burbles, are daily experiences of persons in moving vehicles who cannot only hear these burbles but can also feel their vibrations and experience them to an often violent and disruptive degree.

Experiment indicates that efficient wind noise suppression is not a practical objective to be accomplished selectively from the message itself. And a noise-free atmosphere for the reception of the message can be accomplished only by a complete elimination of the cause of the noise before it can interfere and intermingle with the message. Tests have further shown that the cause of said noise pollution is wind caused eddy currents, or burbles, whose energy is picked up by the hearing aid circuitry as noise which pollutes or overwhelms any concurrent audio message in progress.

Thus, when immersed in a wind or any flow of air, the ear itself and its convolutions disrupt the main flowing airstream and form therein audible eddy current vibrations and burbles. Further, all irregularities in the hearing aid body itself and all projecting controls create additional burbles. Experiment further indicates that the source of the wind noise pollution may not be solely at the microphone orifice but at sound wave leaks in the loose construction of the system and from the entire frame of the hearing aid itself acting as a sounding board.

Thus, it appears that these factors allow wind noise and other pollution to influence microphone pickup as if it had been introduced into the microphone feed itself. These experiments indicate that efficient wind noise elimination can be accomplished only with a blanket covering over the complete external physical mechanism of that portion which is exposed to the external environment. Blankets of downy-napped, open-cellular material which allow free passage of air through the fiber interstices were found in general to be preferred in most conditions of wind velocities. In tests involving high or variable and gusty wind conditions secondary or stacked patches proved to be a viable concept depending upon the type of chosen patch material.

The blanket patch is affixed by means of an adhesive backing which is applied so as to preserve the porous nature of the fiber blanket patch acoustic and electronic compatibility properties by either coating or impregnating only the individual fibers of the patch surface to be so applied and thus to retain the voids and porosity of said blanket.

Experimental work has produced satisfactory press-apply adhesive surface by the use of aerosol spraying of the patch on the spacially separated fibers whereby the fiber interstices was found to be well preserved. An alternative method of adhesive application is the application of spacially separated adhesive dots or other configurations on the area to be so treated.

Alternately, said blanket patch may be affixed to the external ear by the application of a layer of adhesive to the periphery of said patch whereby to affix it to the outer ear area. Thus, the patch may be used for special purpose situations requiring special adhesives for sensitive skin, sore ear and facial areas requiring affixing to a more distant area, or for the use and need of specialized or stronger adhesives for special needs.

Most commercial wind noise suppressor attachments are installed at a hearing aid shop and remain permanently on the aid. This wind-vortex eliminator patch may be immediately press-applied and removed by the hearing aid wearer whenever and wherever the occasion demands. Thus, it may be affixed immediately by the wearer whenever presented with sudden blustery outdoor conditions in golf, field events, and other sporting situations, either as an observer or as a participant, and thereafter it may be immediately removed and discarded. It is also ideal for hunters, fisherman, and other outdoorsmen and mariners.

For the ear insertion type hearing aid, this blanket patch may cover a relatively large area of the ear itself over and beyond the hearing aid and be quite noticeable. This situation is a valuable asset. So long as the patch itself retains adequate porosity whereby to be free from internal electronic interference and significant aural diminution this asset could take such forms as a possible fashion item or a novelty item sporting various colors and decorations of ornaments and flash, timely cartoon characters for children, a possible fun item, an advertising item, and it may be fashioned in any popular or designated outline or shape.

The blanket patch may also be medicated whereby to serve as an antiseptic item and an elective specific whereby to protect the ear passage from incursions of infectious organisms and to prevent the spread of said infectious organisms already germinating in said air passage into the external environment.

This wind-vortex preventer blanket is designed for economy and fabricated to be the most effective and efficient, trouble free, simple, convenient, and versatile solution to the hearing aid wind noise problem. It is also conceived to be a replacement for all wind noise suppressor accessories and contrivances on today's market. It is pliable and easily shaped to adapt to all hearing aids having a microphone opening in their outer structure. Thus, this wind noise preventer blanket constitutes a universal accessory for all makes of hearing aids.

This invention is not designed to suppress or diminish hearing aid wind noise, it is designed to eliminate its cause.

All hearing aid noise modification inventions in this field are designed to suppress or to diminish existing wind noise. An additional advantage of this invention is that it eliminates wind noise formation and thus it eliminates all need for its suppression.

Another advantage of this adhesive-coated fiber blanket is that independent test laboratory results show the efficiency of the adhesive-coated fibers to rank with that of the untreated fibers as used in previous wind noise relief patents.

All previously noted hearing aid noise-relief patents require use preparation previously or at the time of use. The advantage of this invention is that without inspection or preparation, immediate use is secured by grabbing a patch and pressing it against the ear.

The primary object of this invention is to cover and streamline the flow of air moving across the ear and across all immediate natural and contrived irregularities that would tend to break up its energy into eddy currents which cause audible interference with an otherwise acceptable audible message. Due to said audible interference, entire conversations may be lost or misinterpreted during blustery or inclement weather, and many situations may be coped with that might not have been audibly understood otherwise.

A further object of this invention is to further utilize the blanket outer surface area as a fully accepted area for exhibiting items, decoration embellishment, and manufacturer's information.

The medical needs of the inner ear are many, and the needs for sanitation in this area are readily apparent. Thus, another object herewith is to produce a medicated antiseptic blanket patch for use in both the prevention of infection therein and the spread of any infectious organisms therefrom.

BRIEF DESCRIPTION OF THE DRAWINGS

A preferred embodiment of this invention is illustrated in the attached drawings in which.

DETAILED DESCRIPTION OF THE INVENTION

Figure 1:
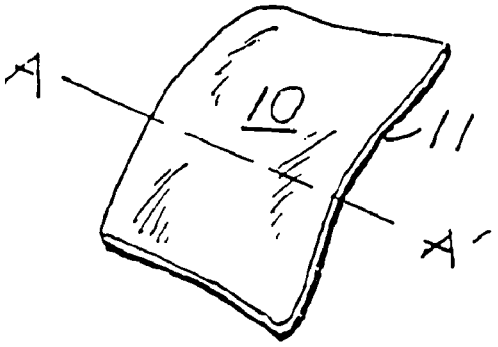
FIG. 1 is a perspective view of the hearing aid wind-vortex noise preventer blanket patch accessory.
Figure 2:
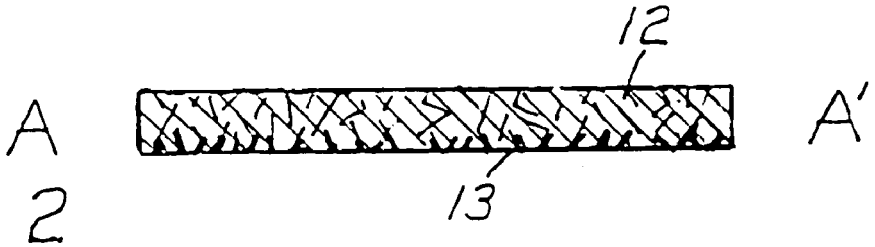
FIG. 2 is a magnified representation of the cross-section of aid blanket patch noting its open cellular nature and the application of the fiber adhesive.

Illustrated in FIG. 1 is open cellular fiber blanket patch 10 which is so constituted to allow free passage of air through its fiber interstices. A press-apply adhesive is applied to the blanket fibers of surface 11 by either impregnation or by a light coating in a manner whereby to preserve the open cellular integrity of said blanket itself. Blanket cross-section A-A' is shown in FIG. 2 as a magnified representation of said cross-section emphasizing the open cellular nature of said patch 10 whereby there is free passage of air through the interstices of blanket fibers 12 from the outer atmosphere to hearing aid 14 as noted in FIG. 3 and further notes a light adhesive coating 13 on said fibers of said side 11 of FIG. 1 and further noting the open cellular spacing of said fibers 12 after coating. An optional method of adhesive application which has been found equally effective is the impregnation of fibers 12 in the same location as noted for said fiber coating.

Figure 3:
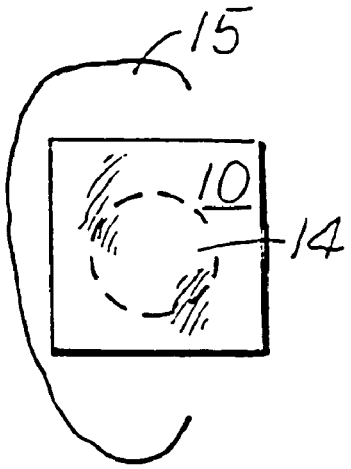
FIG. 3 is a lateral spacial diagram of the blanket patch when used with the ear insertion type hearing aid.

FIG. 3 is a lateral spacial representation of said blanket patch 10 when it is utilized with an ear-inserted type of hearing aid. Thus, ear insertion type hearing aid 14 is emplaced in ear 15, and blanket patch 10 is press-applied over said hearing aid and also over as much of said ear as is deemed necessary to insulate said hearing aid from the external environment. Many types of hearing aids are designed and manufactured to fit deeply and unobstrusively in the inner ear canal where it would be too deeply embedded to apply said blanket patch thereto, and said patch would necessarily be applied to the outer ear area over said hearing aid location.

I claim:

1. A wind-vortex-noise preventer blanket patch accessory for removable attachment to an ear-mounted hearing aid having an outer surface, comprising a patch of porous fabric having an inner napped surface, said patch sized to cover said outer surface of said ear-inserted hearing aid;

a porosity-preserving adhesive applied to the inner napped surface of the patch, whereby said patch may be removably attached to the outer surface of the ear-inserted hearing aid.

2. The device according to claim 1, wherein said inner napped surface has individual surface fibers to which said adhesive is applied as a coating.

3. The device according to claim 2 wherein said patch is impregnated with a medicinal antiseptic.

4. The device according to claim 1, wherein said individual surface fibers are impregnated with the adhesive.

5. The device according to claim 4 wherein said patch is impregnated with a medicinal antiseptic.

6. The device according to claim 1 wherein said patch is disposable.

7. A wind-vortex-noise preventer blanket patch accessory for removable attachment over an ear-inserted hearing aid having an outer surface, comprising a patch of porous fabric having an inner napped surface, said patch sized to cover said outer surface of said ear-inserted hearing aid;

a porosity-preserving adhesive applied to the inner napped surface of the patch, whereby said patch may be removably attached over the outer surface of the ear-inserted hearing aid.

8. The device according to claim 7, wherein said inner napped surface has individual surface fibers to which said adhesive is applied as a coating.

9. The device according to claim 8 wherein said patch is impregnated with a medicinal antiseptic.

10. The device according to claim 7, wherein said individual surface fibers are impregnated with the adhesive.

11. The device according to claim 10 wherein said patch is impregnated with a medicinal antiseptic.

12. The device according to claim 7 wherein said patch is impregnated with a medicinal antiseptic.

13. The device according to claim 7 wherein said device is disposable.

* * * * *